US005267839A

United States Patent [19]

Kimura et al.

[11] Patent Number: 5,267,839

[45] Date of Patent: Dec. 7, 1993

[54] RECIPROCATORY PISTON TYPE COMPRESSOR WITH A ROTARY VALVE

[75] Inventors: Kazuya Kimura; Hiroaki Kayukawa, both of Kariya, Japan

[73] Assignee: Kabushiki Kaisha Toyoda Jidoshokki Seisakusho, Aichi, Japan

[21] Appl. No.: 25,730

[22] Filed: Mar. 2, 1993

Related U.S. Application Data

[63] Continuation of Ser. No. 942,989, Sep. 10, 1992, abandoned.

[30] Foreign Application Priority Data

Sep. 11, 1991 [JP] Japan ..... 3-231853
Sep. 11, 1991 [JP] Japan ..... 3-231856
Sep. 13, 1991 [JP] Japan ..... 3-235026

[51] Int. Cl.[5] ..... F04B 1/14

[52] U.S. Cl. ..... 417/269; 417/517; 91/499

[58] Field of Search ..... 417/516, 517, 518, 519, 417/269; 91/499

[56] References Cited

U.S. PATENT DOCUMENTS 1,364,508 1/1921 Moody ..... 91/499
2,248,449 7/1941 Dudley ..... 417/519
3,482,521 12/1969 Wolf ..... 417/269
3,734,647 5/1973 Sparks ..... 417/269
4,007,663 2/1977 Nagatomo et al. ..... 417/269 X
4,642,032 2/1987 McBeth ..... 417/269
4,749,340 6/1988 Ikeda et al. .
4,764,091 8/1988 Ikeda et al. .
4,781,540 11/1988 Ikeda et al. .

FOREIGN PATENT DOCUMENTS 923985 2/1955 Fed. Rep. of Germany .
258446 7/1988 Fed. Rep. of Germany .
269881 7/1989 Fed. Rep. of Germany .
103728 3/1924 Switzerland .
111613 9/1925 Switzerland .

*Primary Examiner*—Richard A. Bertsch
*Assistant Examiner*—Timothy S. Thorpe
*Attorney, Agent, or Firm*—Burgess, Ryan & Wayne

[57] ABSTRACT

A reciprocatory piston type compressor having an axial cylinder block in which a plurality of axial cylinder bores are formed for receiving pistons therein to compress a refrigerant and to discharge the compressed refrigerant, housings air-tightly connected to the opposite ends of the axial cylinder block to define a suction chamber for the refrigerant before compression, a discharge chamber for the refrigerant after compression, and a chamber for receiving a swash plate accommodated piston reciprocating mechanism operated by a rotatable drive shaft axially extended through the chamber, and a rotary valve element arranged so as to be rotated together with the drive shaft and having a fluid passageway for controlling the supply of the refrigerant from the suction chamber to the respective cylinder bores in response to rotation thereof. The rotary valve element may also have another fluid passageway for controlling the discharge of the compressed refrigerant from the cylinder bores to the discharge chamber in response to rotation thereof.

19 Claims, 11 Drawing Sheets

RECIPROCATORY PISTON TYPE COMPRESSOR WITH A ROTARY VALVE

This application is a continuation-in-part of application Ser. No. 942,989, filed Sept. 10, 1992.

BACKGROUND OF THE INVENTION

1. Field of the Invention

The present invention relates to a reciprocatory piston type multi-cylinder refrigerant compressor for a refrigeration system, and more particularly, it relates to a reciprocatory piston type compressor provided with a rotary valve element for controlling the suction of a refrigerant gas before compression from a suction chamber into respective cylinder bores; the rotary valve may also control discharge of the refrigerant gas after compression from respective cylinder bores toward a discharge chamber.

2. Description of the Related Art

Reciprocatory piston type refrigerant compressors such as a wobble plate operated reciprocatory piston type variable displacement compressor, and a swash plate operated reciprocatory piston type fixed displacement compressor are conventionally used for compressing a refrigerant circulating through a refrigeration system of e.g., an automobile air conditioner. The reciprocatory piston type compressor is provided with an axial cylinder block having a plurality of cylinder bores arranged parallel with a drive shaft of the compressor and a plurality of single headed or double headed pistons reciprocated in the respective cylinder bores to compress the refrigerant in the form of a gas. For example, the compressor having single headed pistons is also provided with a housing attached to one of the axial ends of the cylinder block via a valve plate to define a suction chamber therein from which the refrigerant gas is supplied into respective cylinder bores so as to be compressed, and a discharge chamber therein toward which the compressed refrigerant gas is discharged from the respective cylinder bores. When the refrigerant gas is supplied from the suction chamber into the respective cylinder bores, the gas passes through suction ports formed in the valve plate and closably opened by suction valves arranged so as to be in contact with one end face of the valve plate on the side thereof confronting respective cylinder bores. The suction valves are opened when a pressure level in each cylinder bore is lower than a given low pressure level. Similarly, when the compressed refrigerant gas is discharged from the respective cylinder bores toward the discharge chamber, the compressed refrigerant passes through discharge ports formed in the valve plate and closably opened by discharge valves arranged so as to be in contact with the other end face of the valve plate on the side thereof confronting the discharge chamber. The discharge valves are opened when the pressure level in each cylinder bore is higher than a given high pressure level. It should, however, be noted that these suction and discharge valves arranged on opposite sides of the valve plate of the conventional compressor have the form of a flapper or reed valve, respectively. Namely, each of the suction and discharge valves in the flapper form is made of a thin elastic plate material so that the valve is constantly elastically urged toward the closing position thereof. Therefore, the flapper valve must always be moved from the closing to opening position thereof against the elastic force exerted by the valve per se, and accordingly during the opening of the suction or discharge valve in the flapper form, a considerable amount of refrigerant pressure loss occurs thereby lowering the volumetric efficiency of the compressor.

Further, when the suction or discharge valve in the flapper form returns to the closing position thereof, it strikes against the end face of the valve plate and produces a loud noise, and may additionally be apt to be damaged or broken.

U.S. Pat. Nos. 4,749,340, 4,764,091, and 4,781,540 disclose several constructional improvements of the flapper valve that enhance the volumetric efficiency of the reciprocatory piston type compressor and solve the noise problem. Nevertheless, a further innovative improvement of the function and performance of the suction and discharge valves of the reciprocatory piston type compressor has been requested.

SUMMARY OF THE INVENTION

Therefore, an object of the present invention is to provide a reciprocatory piston type refrigerant compressor provided with a novel valve element accommodated therein capable of eliminating the above-mentioned problems encountered by the conventional flatter form valve.

Another object of the present invention is to provide a reciprocatory piston type multi-cylinder refrigerant compressor provided with a noise free rotary valve element smoothly rotated together with a drive shaft of the compressor so as to control an appropriate supply of a refrigerant from a suction chamber to respective cylinder bores and thereby prevent the loss of pressure during compression of the refrigerant.

A further object of the present invention is to provide a reciprocatory piston type multi-cylinder refrigerant compressor provided with a noise free rotary valve element smoothly rotated together with a drive shaft of the compressor to control not only an appropriate supply of the refrigerant from a suction chamber into respective cylinder bores but also an appropriate discharge of the compressed refrigerant from respective cylinder bores toward a discharge chamber and thereby maintain a high volumetric compressor efficiency.

In accordance with one aspect of the present invention, there is provided a reciprocatory piston type compressor for compressing a refrigerant of a refrigeration system that comprises:

a cylinder block having a central axis thereof, a cylindrical central bore formed to be coaxial with the central axis, and a plurality of axial cylinder bores arranged around and in parallel with the central axis, each axial cylinder bore having at least one bore end through which the refrigerant enters therein, and is discharged therefrom;

a housing unit air-tightly connected via a partition wall plate to opposite axial ends of the cylinder block for defining therein a suction chamber for the refrigerant before compression fluidly communicating with the cylindrical central bore of the cylinder block, and a discharge chamber for the refrigerant after compression located around and isolated from the suction chamber;

a rotatable drive shaft having axial ends thereof rotatably supported by bearings seated in the housing unit and the cylinder block;

a plurality of reciprocatory pistons fitted in the plurality of axial cylinder bores of the cylinder block; each piston being reciprocated in one of the plurality of cylinder bores for suction, compression, and discharge of the refrigerant;

a swash plate-operated piston drive mechanism arranged around the rotatable drive shaft for driving the plurality of reciprocatory pistons in the plurality of cylinder bores in cooperation with the drive shaft;

a constant fluid communication means formed between each of the plurality of cylinder bores and the central bore of the cylinder block; and a rotary valve means arranged in the central bore of the cylinder block and attached to the drive shaft so as to be rotated together with the drive shaft; the rotary valve means being provided with a fluid passageway formed therein for controlling a supply of the refrigerant before compression from the suction chamber of the housing means to at least one of the plurality of cylinder bores via the constant fluid communication means while the cylinder bore is in the suction phase to draw therein the refrigerant before compression in cooperation with the reciprocatory pistons in response to the rotation of the drive shaft and the rotary valve means.

In accordance with another aspect of the present invention, there is provided a reciprocatory piston type compressor for compressing a refrigerant of a refrigeration system that comprises:

a cylinder block having a central axis thereof, a first cylindrical valve chamber bored coaxially with the central axis, and a plurality of axial cylinder bores arranged around and in parallel with the central axis; each axial cylinder bore having at least one bore end through which the refrigerant enters therein, and is discharged therefrom;

a housing unit air-tightly connected via a partition wall plate means to opposite axial ends of the cylinder block for defining therein a suction chamber for the refrigerant before compression fluidly communicating with the first cylindrical valve chamber of the cylinder block, and a discharge chamber for the refrigerant after compression located around and isolated from the suction chamber; the housing unit further defining a second cylindrical valve chamber coaxial with the first cylindrical valve chamber;

a rotatable drive shaft having axial ends thereof rotatably supported by bearings seated in the housing unit and the cylinder block;

a plurality of reciprocatory pistons fitted in the plurality of axial cylinder bores of the cylinder block; each piston being reciprocated in one of the plurality of cylinder bores for suction, compression, and discharge of the refrigerant;

a swash plate-operated piston drive mechanism arranged around the rotatable drive shaft for driving the plurality of reciprocatory pistons in the plurality of cylinder bores in cooperation with the drive shaft;

a first constant fluid communication means formed between each of the plurality of cylinder bores and the first cylindrical valve chamber of the cylinder block;

a second constant fluid communication means formed between the discharge chamber and the second cylindrical valve chamber of the housing unit; and a rotary valve unit arranged in the first and second valve chambers of the cylinder block and the housing unit and attached to the drive shaft so as to rotate together with the drive shaft;

the rotary valve unit provided with a first fluid passageway formed therein for controlling a supply of the refrigerant before compression from the suction chamber of the housing means to at least one of the plurality of cylinder bores via the first constant fluid communication means while the cylinder bore is in the suction phase drawing therein the refrigerant before compression in cooperation with the reciprocatory pistons in response to the rotation of the drive shaft, and a second fluid passageway formed therein for controlling a discharge of the refrigerant after compression from at least one of the plurality of cylinder bores to the discharge chamber via the first and second means for forming constant fluid communication while the cylinder bore is in the discharge phase so as to discharge the refrigerant after compression in cooperation with the reciprocatory pistons in response to the rotation of the drive shaft.

BRIEF DESCRIPTION OF THE DRAWINGS

The above and other objects, features and advantages of the present invention will be made more apparent from the ensuing description of the preferred embodiments thereof in conjunction with the accompanying drawings wherein.

DESCRIPTION OF THE PREFERRED EMBODIMENTS

Figure 1:
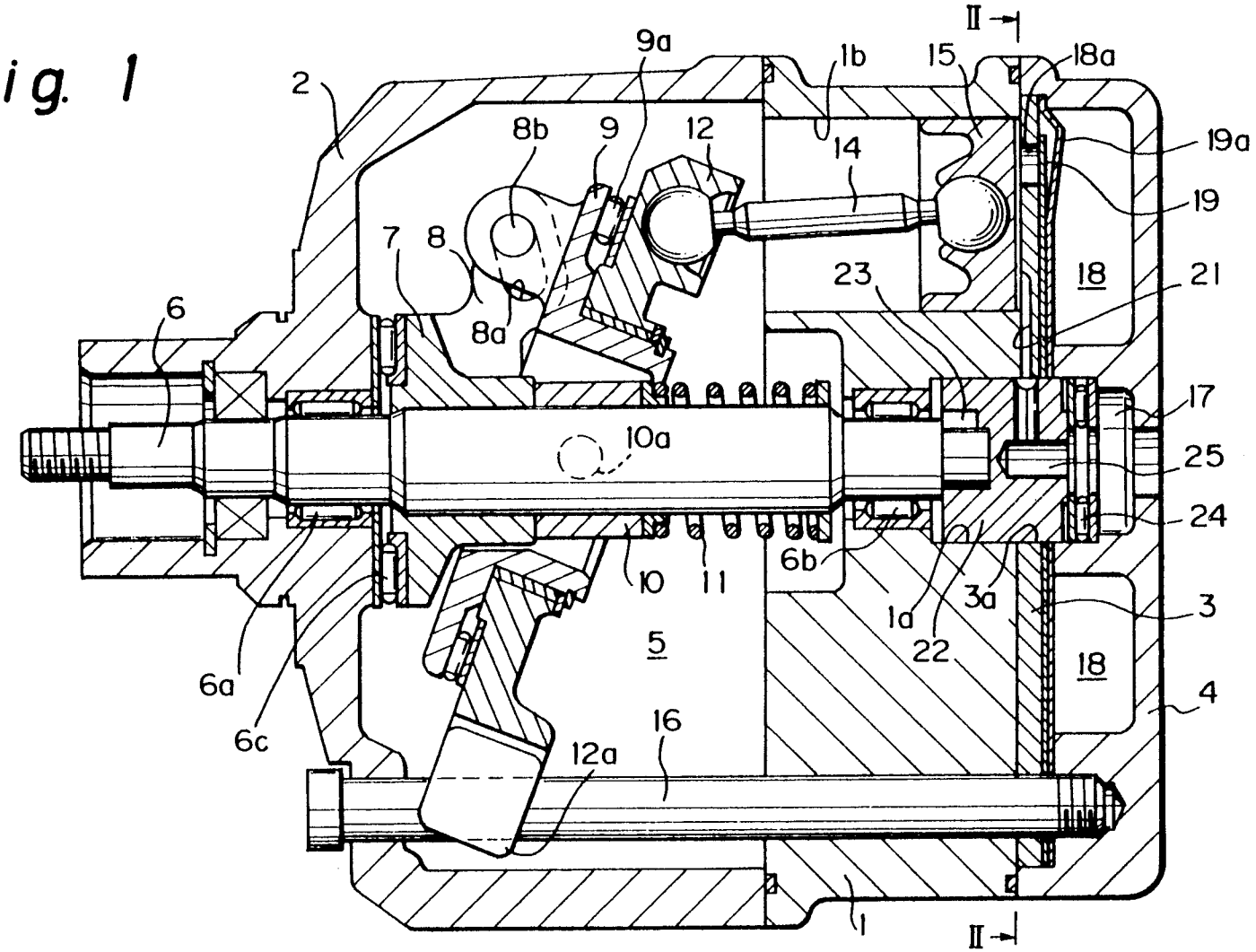
FIG. 1 is a longitudinal cross-sectional view of a reciprocatory piston type refrigerant compressor provided with a rotary valve element according to a first embodiment of the present invention.

Referring to FIGS. 1 through 4, illustrating the first embodiment of the present invention, a reciprocatory piston type refrigerant compressor includes a cylinder block 1 having a central axis. The cylinder block 1 is provided with axially opposite ends, a central bore 1*a* extended coaxially with the central axis and formed as a valve chamber for receiving a later-described rotary valve element, and a plurality of (e.g., five in the embodiment) cylinder bores 1*b* arranged equiangularly around and in parallel with the central axis. One of the axial ends, i.e., a front end of the cylinder block 1 is air-tightly closed by a front housing 2, and the other end, i.e., a rear end of the cylinder block 1 is air-tightly closed by a rear housing 4 via a partition wall plate 3. The front housing 2 defines a crank chamber 5 axially extending in front of the front end of the cylinder block 1. The rear housing 4 defines therein a centrally arranged cylindrical suction chamber 17 for a refrigerant before compression, and an annularly extending discharge chamber 18 for a refrigerant after compression arranged so as to surround and be isolated from the suction chamber 17.

A drive shaft 6 axially extending through the crank chamber 5 is rotatably supported by bearings 6*a* and 6*b* seated in a central bore of the front housing 2 and the central bore 1*a* of the cylinder block 1. The drive shaft 6 has a rotor 7 fixedly mounted thereon to be rotated together and axially supported by a thrust bearing 6*c* arranged between an inner end of the front housing 2 and the frontmost end of the rotor 7. The rotor 7 has a support arm 8 extending from a rear part thereof to provide an extension in which an elongated through-bore 8*a* is formed for receiving a lateral pin 8*b* slidably movable in the through-bore 8*a*. The lateral pin 8*b* is connected to a swash plate 9 arranged around the drive shaft and is capable of changing an angle of inclination thereof with respect to a plane perpendicular to the rotating axis of the drive shaft 6.

A sleeve element 10 axially and slidably mounted on the drive shaft 6 is arranged adjacent to the rearmost end of the rotor 7, and is constantly urged toward the rearmost end of the rotor 7 by a coil spring 11 arranged around the drive shaft 6 at a rear portion thereof. The sleeve element 10 has a pair of laterally extending trunnion pins 10*a* on which the swash plate 9 is pivoted so as to be inclined thereabout.

The swash plate 9 has an annular rear face and a cylindrical flange to support thereon a non-rotatable wobble plate 12 via a thrust bearing 9*a*. The non-rotatable wobble plate 12 has an outer periphery provided with a guide portion 12*a* in which a long bolt 16 is fitted to prevent any rotational play of the wobble plate 12 on the swash plate 9, and the wobble plate 12 is operatively connected to pistons 15 axially and slidably fitted in the cylinder bores 1*b*, via connecting rods 14. When the drive shaft 6 is rotated together with the rotor 7 and the swash plate 9, the wobble plate 12 on the swash plate 9 is non-rotatably wobbled to cause reciprocation of respective pistons 15 in the cylinder bores 1*b*. In response to the reciprocation of the pistons 15, the refrigerant is drawn from the suction chamber 17 into respective cylinder bores 1*b* and compressed therein. The compressed refrigerant is discharged from respective cylinder bores 1*b* toward the discharge chamber 18 from which the refrigerant after compression is delivered to the condenser of a refrigeration system.

During the operation of the compressor, when a change in a pressure differential appears between a suction pressure in each cylinder bore 1*b* and a pressure prevailing in the crank chamber 5, the stroke of each piston 15 is changed, and therefore, the angle of inclination of the swash plate 9 and the wobble plate 12 is changed. The pressure in the crank chamber 5 is adjustably changed by a conventional solenoid control valve (not shown in FIG. 1) housed in an extended portion of the rear housing 4.

Figure 2:
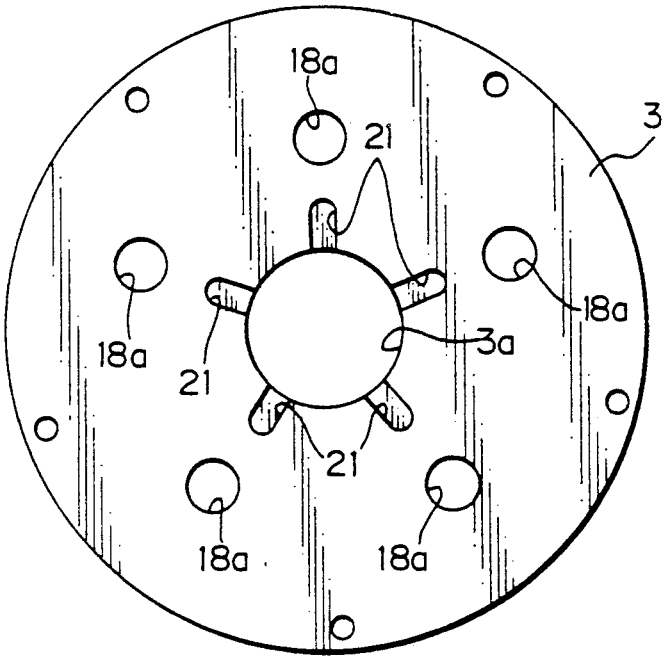
FIG. 2 is a front view of a partition wall plate of the compressor, taken along the line II—II of FIG. 1 and illustrating an arrangement of radial passageways formed in an end face thereof.

The afore-mentioned central suction chamber 17 of the rear housing 4 has an opening formed in an end wall of the rear housing 4 so that the suction chamber 17 is able to receive a refrigerant therein when the refrigerant returns from the exterior of the compressor. The suction chamber 17 is communicated with the central bore 1*a* of the cylinder block 1 via a central bore 3*a* of the partition wall plate 3 arranged so as to be coaxial with and having a bore diameter equal to the central bore 1*a* of the cylinder block. The partition wall plate 3 is provided with a plurality of (five in this embodiment ) radial passageways 21 formed to extend radially from the central bore 3*a* thereof, as best shown in FIG. 2. An end of each radial passageway 21 is located to open toward the rearmost end of one of the axial cylinder bores 1*b* of the cylinder block 1.

A cylindrical rotary valve element 22 is smoothly and rotatably accommodated in the central bore 1*a* of the cylinder block 1 and the central bore 3*a* of the partition wall plate 3, and an axially inner end of the rotary valve element 22 is fixedly attached by a key 23 to an end of the drive shaft 6 extending into the central bore 1*a* of the cylinder block. Thus, the rotary valve element 22 is rotated together with the drive shaft 6. The drive shaft 6 and the rotary valve element 22 of the compressor according to the present embodiment may be rotated in either the CW direction or CCW direction. A rear end of the rotary valve element 22, i.e., an end opposite to the above-mentioned inner end is supported by a thrust bearing 24 seated in an annular step of the suction chamber formed in the inner wall of the rear housing 4.

Figure 3:
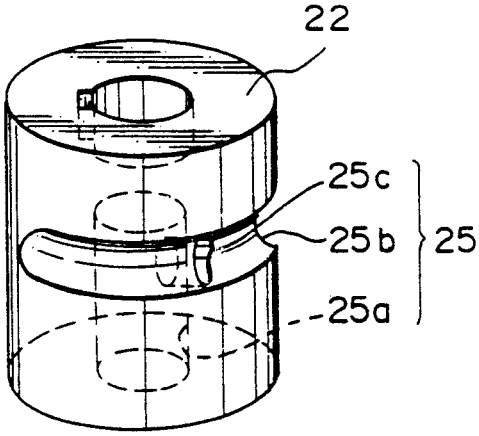
FIG. 3 is a perspective view of a rotary valve element incorporated in the compressor of FIG. 1.
Figure 4:
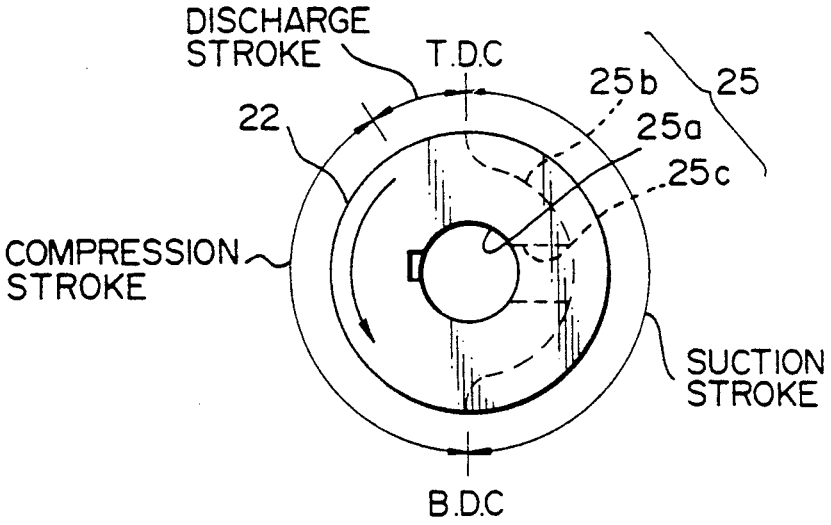
FIG. 4 is a plan view of the rotary valve element of FIG. 3, illustrating an arrangement of a suction refrigerant passageway formed therein.

As best shown in FIGS. 3 and 4, the cylindrical rotary valve element 22 is provided with a fluid passageway 25 including an axial blind bore 25*a* centrally formed therein, a groove 25*b* formed in the cylindrical surface thereof to circumferentially extend over approximately a half of the circumference thereof, and a radial bore 25*c* formed to provide a fluid communication between the central bore 25*a* and the circumferential groove 25*b*. The fluid passageway 25 of the rotary valve element 22 is provided to control the suction of the refrigerant from the suction chamber 17 of the rear housing 4 into respective cylinder bores 1*b*. Namely, during the rotation of the rotary valve element 22, while the circumferential groove 25*b* of the rotary valve element 22 is met with the radial passageways 21 of the cylinder bores 1*b* in which the suction stroke of the pistons 15 is carried out, fluid communication is provided between these radial passageways 21 and the suction chamber 17 through the fluid passageway 25.

The discharge chamber 18 of the rear housing 4 arranged radially outside the suction chamber 17 can be communicated with respective cylinder bores 1*b* via discharge ports 18*a* formed in the partition wall plate 3 and discharge valves 19 in the flapper form disposed in the discharge chamber 18 to close the discharge ports 18*a*. The movement of the discharge valves 19 are restricted by valve retainers 19*a*.

The above-described reciprocatory piston type compressor is incorporated in a refrigeration system of an air-conditioner such as an automobile air-conditioner to compress the refrigerant and deliver the compressed gas into the refrigeration system.

The operation of the compressor with the rotary valve element 22 will be described hereunder.

When the drive shaft 6 of the compressor is rotated about the rotating axis thereof by an external drive power, the swash plate 9 is rotated together and wobbled around the drive shaft 6 due to an inclination of the swash plate 9 with respect to a plane perpendicular to the rotating axis of the drive shaft 6. The wobbling motion of the rotating swash plate 9 causes a synchronous wobbling of the non-rotatable wobble plate 12, so that the respective pistons 15 connected to the wobble plate 12 via the connecting rods 14 are reciprocated in the respective cylinder bores 1*b*. During the reciprocation of the pistons 15, when each of the pistons 15 starts to slide in the corresponding cylinder bore 1*b* from top dead center (T.D.C.) toward bottom dead center (B.D.C.) thereof to conduct a suction stroke thereof, the rotary valve element 22 rotating together with the drive shaft 6 in e.g., the CCW direction shown in FIG. 4 is brought into a position whereat the leading end of the circumferential groove 25*b* of the fluid passageway 25 thereof is met with the radial passageway 21 of the cylinder bore 1*b*, and accordingly the radial passageway 21 of the cylinder bore 1*b* is fluidly communicated with the suction chamber 17 via the fluid passageway 25 of the rotary valve element 22. Thus, the refrigerant gas is drawn from the suction chamber 17 into the cylinder bore 1*b* through the fluid passageway 25 and the radial passageway 21.

Subsequently, when the piston 15 is moved to the B.D.C in the cylinder bore 1*b*, the tail end of the circumferential groove 25*b* of the rotating rotary valve element 22 passes the radial passageway 21 of the cylinder bore 1*b* in which the piston 15 arrives at the B.D.C.. Thus, the radial passageway 21 of the cylinder bore 1*b* is disconnected from the suction chamber 17 by the rotary valve element 22. Then, when the piston 15 starts to slide in the cylinder bore 1*b* from the B.D.C toward the T.D.C thereof, the refrigerant gas drawn into the cylinder bore 1*b* is compressed by the piston 15, and therefore, a pressure prevailing in the cylinder bore 1*b* is gradually increased to a level capable of urging the discharge valve 19 to move from the closing toward the open position thereof. Accordingly, the compressed refrigerant is discharged from the cylinder bore 1*b* into the discharge chamber 18 via the discharge port 18*a* of the partition wall plate 3.

From the foregoing description, it will be understood that the rotary valve element 22 rotating together with the drive shaft 6 controls the supply of the refrigerant from the suction chamber 17 of the rear housing 4 toward the respective cylinder bores 1*b* to thereby achieve an appropriate compression of the refrigerant gas and a discharge of the compressed refrigerant gas.

According to the present embodiment of FIGS. 1 through 4, since the rotary valve element 22 is constructed as a rotary suction control valve rotating together with the drive shaft 6 of the compressor, it is possible to obtain a wide opening area of the suction control valve compared with the conventional flapper-form suction control valve. Therefore, the volumetric efficiency of the compressor per se can be raised due to a lowering of pressure loss of the refrigerant in each of the plurality of cylinder bores 1*b* of the compressor.

Further, the rotary suction valve element 22 can significantly reduce noise during the operation thereof compared with the conventional flapper-form suction control valve. In addition, since the rotary suction valve element 22 performs the suction control operation thereof by smooth rotation in the valve chamber, damage or breakage and abrasion of the rotary suction control valve do not easily occur for a long operation time thereof. Thus, an improvement of the suction valve mechanism of the reciprocatory piston type compressor over the conventional flapper-form suction control valve can be achieved.

Figure 5:
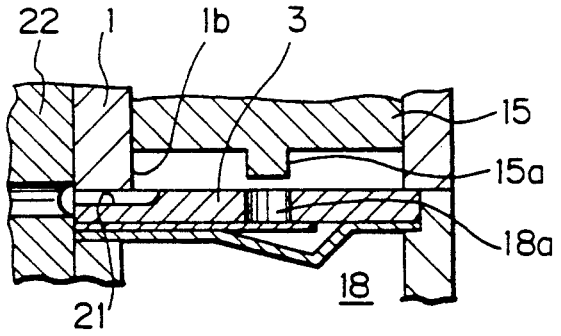
FIG. 5 is a partial schematic and cross-sectional view of a portion of a reciprocatory piston type multi-cylinder refrigerant compressor, illustrating a constructional variation from the embodiment of FIG. 1.

FIG. 5 illustrates a modification of the reciprocatory piston type compressor of FIG. 1. Namely, when the rotary valve element 22 is incorporated in the compressor as a suction control valve, the conventional flapper-form suction control valves are arranged so as to be in contact with the partition wall plate 3. Therefore, the discharge ports 18*a* of the partition wall plate 3 through which the compressed refrigerant is discharged from the respective cylinder bores 1*b* toward the discharge chamber 18 may be provided in a position such that the center of each discharge port 18*a* is in correct alignment with the central axis of the corresponding cylinder bore 1*b*. Thus, each reciprocatory piston 15 may have a projection 15*a* at the head thereof so as to be engageable with the corresponding discharge port 18*a* in response to the movement of the piston 15 toward top dead center (T.D.C.) thereof, and accordingly the piston 15 can always be moved in the cylinder bore 1*b* to a position permitting a minimal gap between the piston head thereof and the inner end face of the partition wall plate 3. Therefore, the amount of compressed refrigerant gas remaining in the cylinder bore 1*b* without being discharged therefrom is minimal so that the volumetric efficiency of the compressor can be increased.

Figure 6:
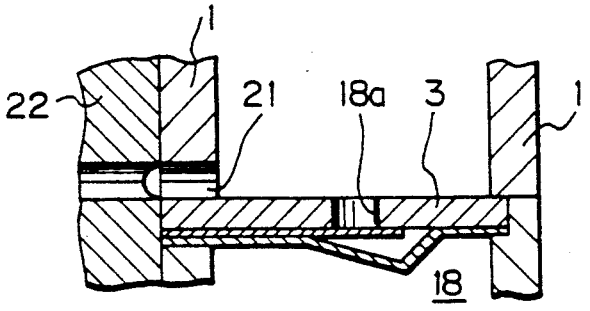
FIG. 6 is a view similar to FIG. 5, illustrating another constructional variation from the embodiment of FIG. 1.

FIG. 6 illustrates another modification of the reciprocatory piston type compressor of FIG. 1. Namely, in the construction of the compressor of FIG. 6, the radial passageways 21 are arranged in the cylinder block 1 instead of the afore-described partition wall plate 3. As a result, the length of each radial passageway 21 can be made shorter, and accordingly, any compressed refrigerant gas remaining in the radial passageway 21 at the time the piston 15 comes to the end of the discharge stroke thereof can be reduced to the minimal amount. Consequently, the volumetric efficiency of the compressor can be raised.

Figure 7:
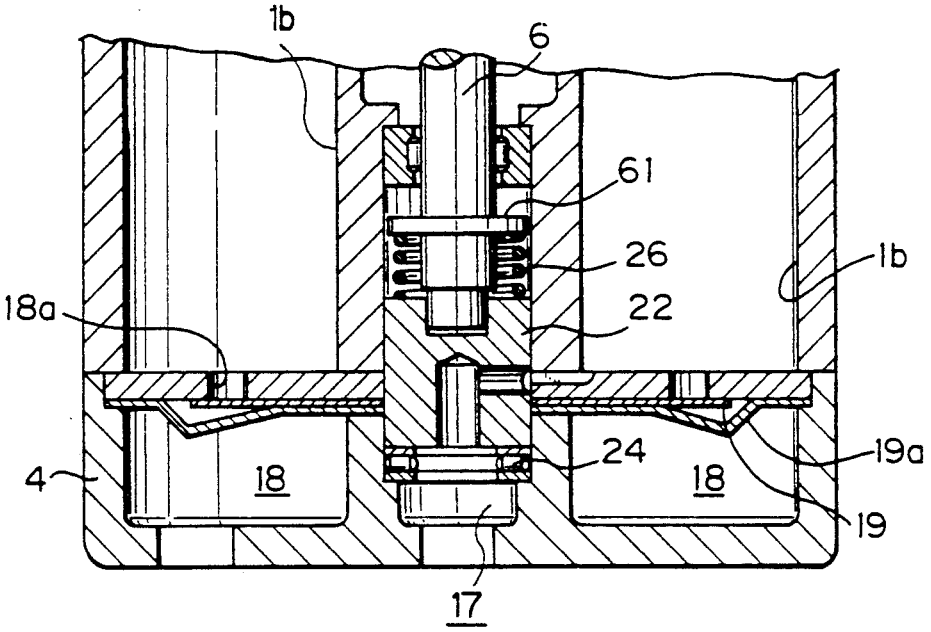
FIG. 7 is a partial schematic cross-sectional view of a portion of a reciprocatory piston type compressor, illustrating a further constructional variation from the embodiment of FIG. 1.

FIG. 7 illustrates a further modification of the reciprocatory piston type compressor of FIG. 1. Namely, in the construction of the compressor of FIG. 7, the drive shaft 6 is provided with a flange portion 61 to support one end of a coil spring 26 the other end of which is in contact with the rotary valve element 22 to thereby always urge the rotary valve element 22 toward the thrust bearing 24 seated in the rear housing 4. Thus, any axial play of the rotary valve element 22 can be cancelled to ensure a smooth rotation of the rotary valve element 22, and accordingly, abrasion and seizure of the rotary valve element 22 can be prevented. Further. difficulty in controlling the dimension and size of the rotary valve element 22 during the production and assembly stages thereof can be mitigated.

Figure 8:
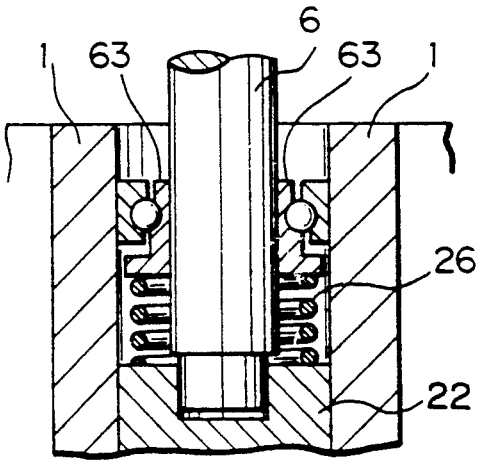
FIG. 8 is a partial schematic view of a portion of a reciprocatory piston type compressor, illustrating a still further constructional variation from the embodiment of FIG. 1.

The coil spring 26 of FIG. 7 may be arranged between the rotary valve element 22 and a radial bearing 63 shown in FIG. 8, which is arranged so as to rotatably support the drive shaft 6 instead of the bearing 6*b* of FIG. 1 or FIG. 7. The bearing 63 is provided with a flanged inner race against which the end of the coil spring 26 is bore, and therefore the drive shaft 6 can be made of a straight member having no flange. Namely, the assembly of the rotary valve element 22 can be simplified compared with the compressor of FIG. 7.

Figure 9:
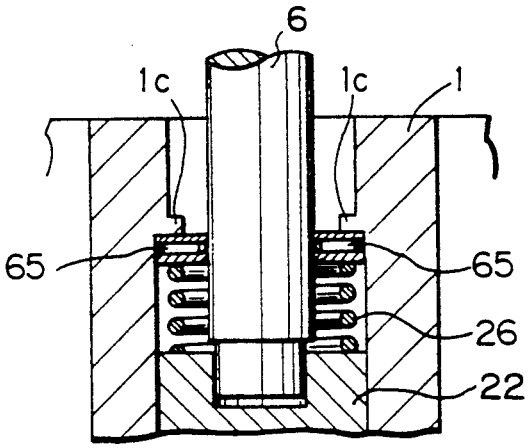
FIG. 9 is a partial schematic view of a portion of a reciprocatory piston type compressor, illustrating a further constructional variation from the embodiment of FIG. 1.

FIG. 9 illustrates another modification in which the spring 26 urging the rotary valve element 22 is supported by a thrust bearing 65 seated on a step 1*c* of the cylinder block 1. Thus, assembly of the rotary valve element 22 can be simple similarly to the embodiment of FIG. 8.

Figure 11:
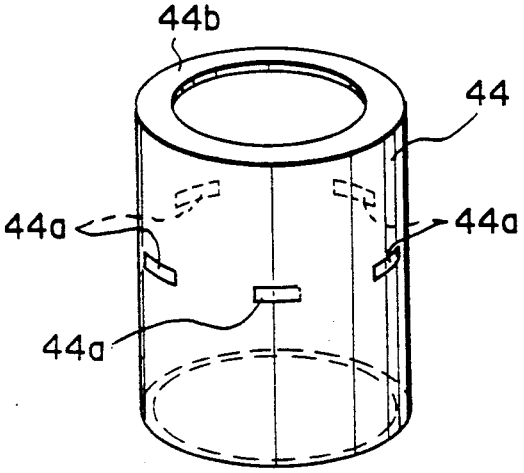
FIG. 11 is a perspective view of a cylindrical valve retainer element incorporated in the compressor of FIG. 10.
Figure 10:
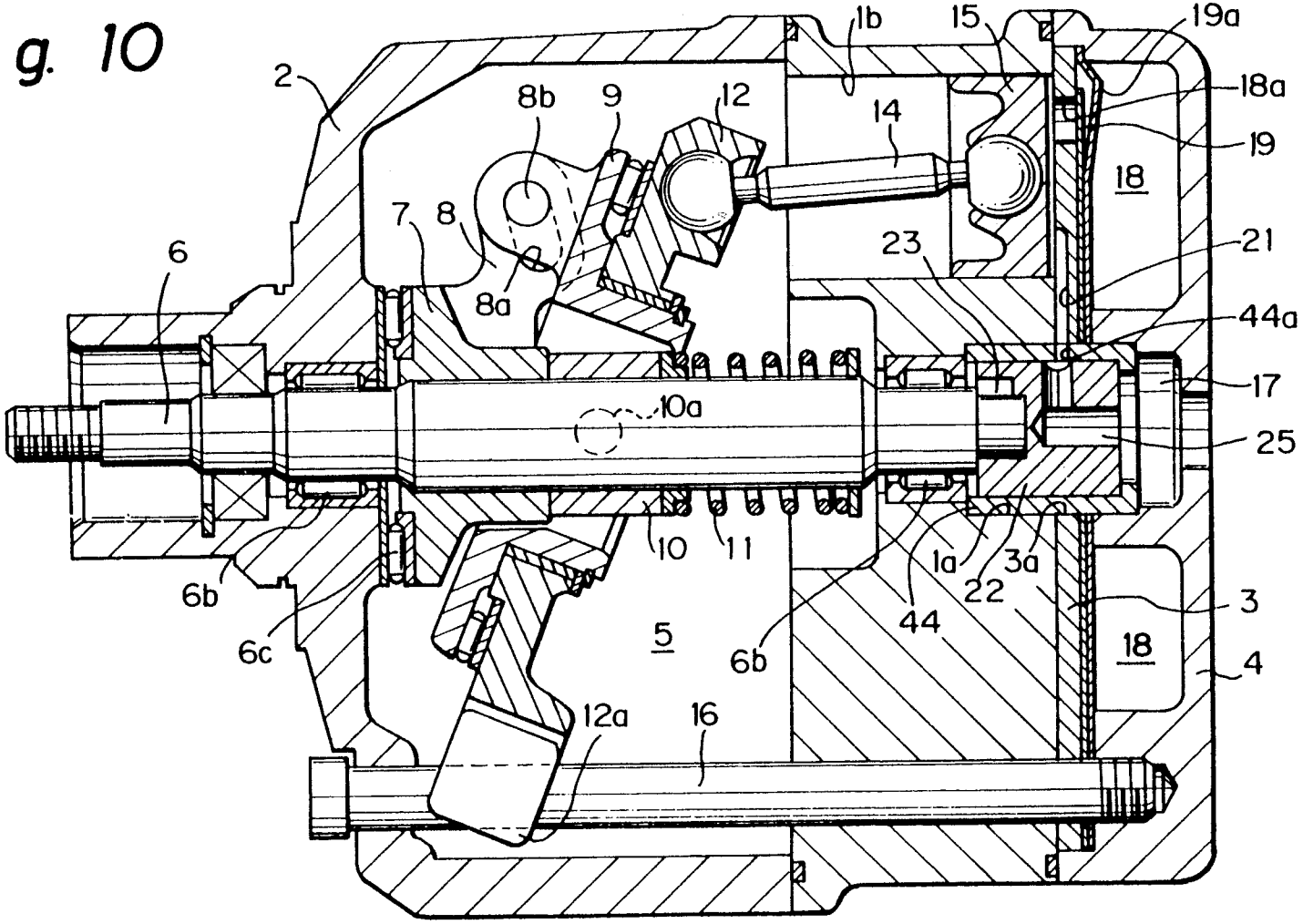
FIG. 10 is a longitudinal cross-sectional view of a reciprocatory piston type refrigerant compressor provided with a rotary valve element according to a second embodiment of the present invention.
Figure 12:
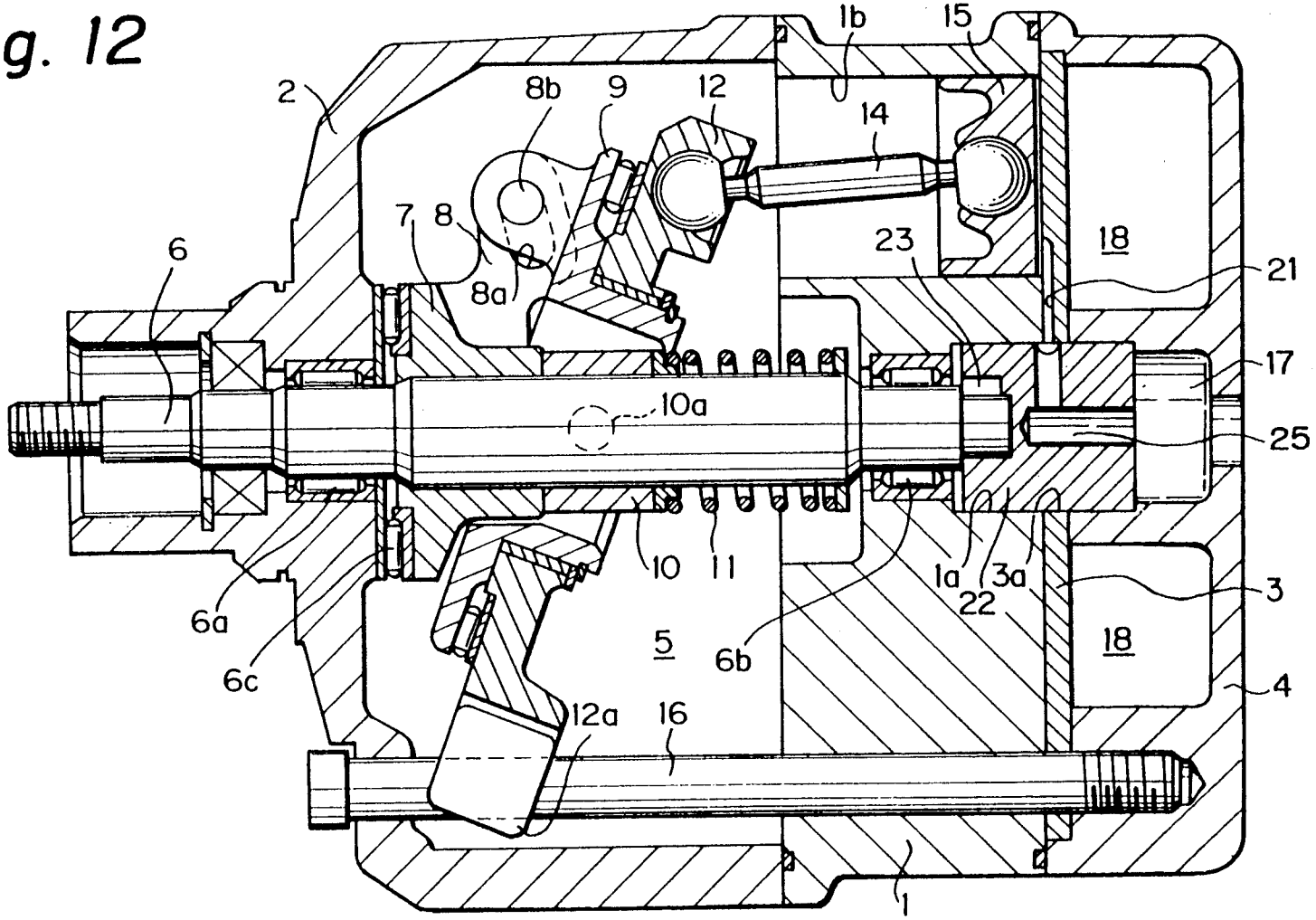
FIG. 12 is a longitudinal cross-sectional view of a reciprocatory piston type refrigerant compressor provided with a rotary valve element according to a third embodiment of the present invention.

Referring to FIGS. 10 and 11 illustrating a second embodiment of the present invention, the reciprocatory piston type compressor is different from the compressor of the first embodiment shown in FIG. 1 through 4 in that a cylindrical hollow sleeve element 44 is fixedly accommodated in the central bore 1*a* of the cylinder block 1 and the central bore 3*a* of the partition wall plate 3 to rotatably receive the rotary valve element 22 therein, and therefore, the thrust bearing 24 used with the compressor of the first embodiment is eliminated. Thus, the same or like elements as those of the compressor of the first embodiment are designated by the same reference numerals as those of FIG. 1 through 4.

As best shown in FIG. 11, the cylindrical hollow sleeve element 44 is provided with a plurality of open windows 44*a* radially formed in the cylindrical wall thereof and an annular extension 44*b* formed at an end thereof seated in a shoulder portion of the rear housing 4.

The open windows 44*a* of the cylindrical hollow sleeve element 44 are arranged in such a manner that when the sleeve element 44 is assembled in the cylinder block 1 and the rear housing 4, the plurality of open windows 44*a* are in correct registration with the respective radial passageways 21 of the partition wall plate 3. Therefore, the fluid passageway 25 of the rotary valve element 22 can be sequentially communicated with the radial passageways 21 and the corresponding cylinder bores 1*b* of the cylinder block 1 in response to the rotation of the rotary valve element 22 within the cylindrical sleeve element 44.

The above-mentioned annular extension 44*b* of the cylindrical hollow sleeve element 44 is provided for axially supporting the rotary valve element 22.

The provision of the cylindrical hollow sleeve element 44 is effective for allowing the rotary valve element 22 to smoothly rotate therein together with the drive shaft 6, because when the hollow sleeve element 44 is made of a metallic bearing material, this hollow sleeve element 44 is able to function as a cylindrical slide bearing for the rotary valve element 22 during the rotation of the rotary valve element 22. Consequently, any loss of power for driving the drive shaft 6 of the compressor from an external drive source such as an automobile engine can be prevented.

Also, the occurrence of an unfavorable problem such as abrasion and seizure of the rotary valve element 22 can be avoided.

The cylindrical hollow sleeve element 44 is assembled in a cylindrical bore-like valve chamber portion of the compressor formed by the combination of the cylinder block 1, the partition wall plate 3 and the rear housing 4, and therefore, it is often difficult for the rotary valve element 22 to obtain a complete air-tight sealing characteristics. Nevertheless, because of provision of the cylindrical hollow sleeve element 44 in which the rotary valve element 22 is rotatably housed, the sealing characteristics of the rotary valve element 22 can be improved over the embodiment of the afore-described first embodiment of FIGS. 1 through 4 and thus, good suction control of the rotary valve element 22 can be obtained.

Moreover, difficulty in controlling the dimension and size of the above-mentioned cylinder block 1, the partition wall plate 3, the rear housing 4, and the rotary valve element 22 during the production and assembly stage of the compressor can be minimized.

FIGS. 12 through 18 illustrate a third embodiment of the present invention, and the same and like elements and portions as those of the first embodiment of FIGS. 1 through 4 are designated by the same reference numerals.

Referring to FIGS. 12 through 16, the rotary valve element 22 is arranged in the valve chamber defined by the central bore 1*a* of the cylinder block 1, the central bore 3*a* of the partition wall plate 3, and a portion of an internal cylindrical wall 43 (FIG. 15) of the rear housing 4. It is to be noted that in the present third embodiment the rotary valve element 22 is provided as a rotating valve having the ability to control both suction and discharge of the refrigerant with respect to the plurality of cylinder bores 1*b* of the cylinder block 1. Therefore, the compressor has no flapper-form valve. It should, however, be noted that the suction, compression, and discharge operations are conducted by reciprocation of the pistons 15 in the cylinder bores 1*b* caused by the swash and wobble plates 8 and 9 when driven by the the drive shaft 6 in the same manner as the compressor of the first embodiment.

The description of the construction and operation of the rotary valve element 22 capable of exhibiting both suction and discharge control performance will be given below.

Figure 13:
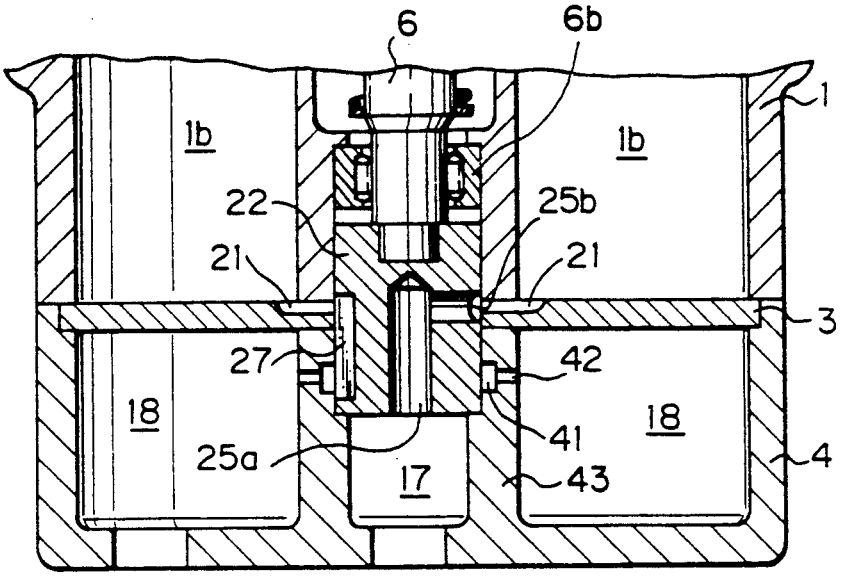
FIG. 13 is a partial another longitudinal crosssectional view of the compressor of FIG. 12, illustrating the construction of a rotary valve element incorporated in the compressor.
Figure 14:
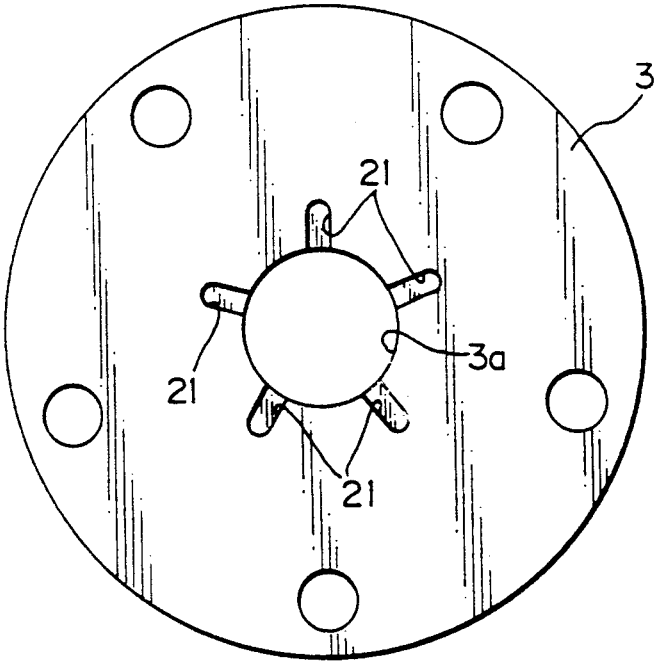
FIG. 14 is a front view of a partition wall plate of the compressor of FIG. 12, illustrating an arrangement of radial passageways formed in one end face thereof.
Figure 16:
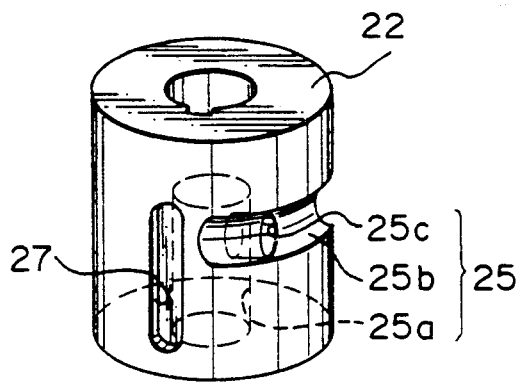
FIG. 16 is a perspective view of a rotary valve element incorporated in the compressor of FIGS. 12 and 13.
Figure 17:
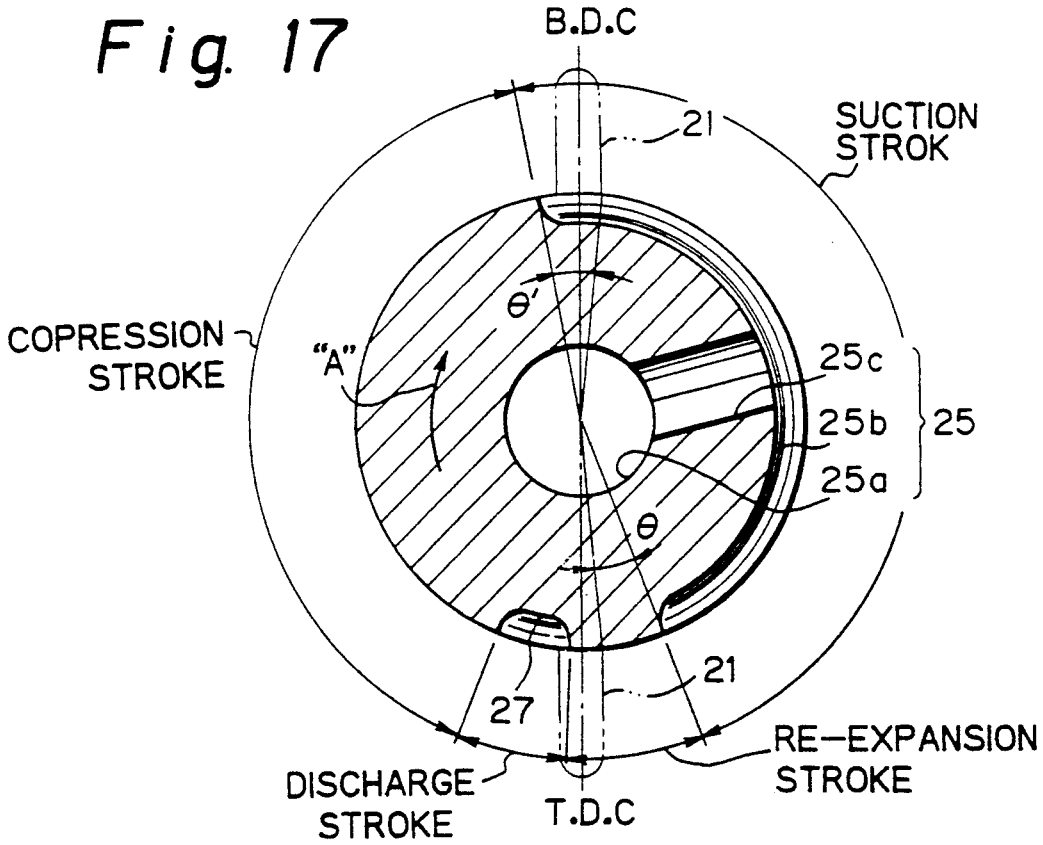
FIG. 17 is a cross sectional view of the rotary valve element of FIG. 16, illustrating an arrangement of a suction refrigerant passageway and a discharge refrigerant passageway formed therein.

Referring to FIGS. 13, 16, and 17, the rotary valve element 22 attached to an end of the drive shaft 6 is provided with a fluid passageway 25 including an axial blind bore 25*a* centrally formed therein, a circumferential groove 25*b* formed in the cylindrical outer surface thereof, and a radial passageway 25*c* providing a connection between the bore 25*a* and the groove 25*b* for controlling the supply of the refrigerant before compression from the suction chamber 17 to the respective cylinder bores 1*b* while the respective cylinder bores 1*b* are in the suction stage.

The rotary valve element 22 is also provided with an axially extending groove-like passageway 27 formed in the cylindrical outer surface thereof. The passageway 27 is located adjacent to but spaced from one end, i.e., a leading end of the circumferential groove 25*b* of the fluid passageway 25 when considering a predetermined rotating direction of the rotary valve element 22, shown by an arrow "A" in FIG. 17. The spacing between the passageway 27 and the leading end of the circumferential groove 25*b* is selected and designed in the manner described later.

As shown in FIG. 13, one end of the axial groove-like passageway 27 is disposed adjacent to the rearmost end of the rotary valve element 22, and the other end thereof is disposed at a position whereat the passageway 27 is capable of communicating with the respective radial passageways 21 of the partition wall plate 3 ( FIG. 14) during the rotation of the rotary valve element 22.

Figure 15:
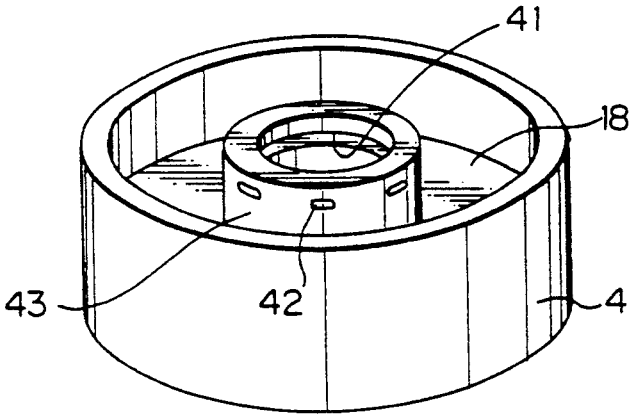
FIG. 15 is a perspective view, in a small scale, of a rear housing of the compressor of FIG. 12.

Referring to FIGS. 13 and 15, the cylindrical wall 43 of the rear housing 4 is provided with an internal annular groove 41 at a position capable of being constantly exposed to the above-mentioned axial groove 27 of the rotary valve element 22, and an appropriate number of radial bores 42 connecting between the discharge chamber 18 and the internal annular groove 41 of the cylindrical wall 43 of the rear housing 4.

In accordance with the above-described construction and arrangement of the rotary valve element 22, when the rotary valve element 22 is rotated together with the drive shaft 6, and when the axial passageway 27 comes to positions whereat it is met with the radial passageway 21 of the cylinder bore 1*b* wherein the discharge stroke of the piston 15 is proceeded, the cylinder bore 1*b* is fluidly communicated with the discharge chamber 18 of the rear housing 4 via the radial passageway 21 and the axial passageway 27 of the rotary valve element 22. The fluid communication of the axial passageway 27 of the rotary valve element 22 with respective cylinder bores 1*b* sequentially occurs thereby permitting the compressed refrigerant to be discharged from the cylinder bores lb toward the discharge chamber 18 in response to the rotation of the rotary valve element 22. Namely, the rotary control valve element 22 has a function of controlling the discharge of the compressed refrigerant gas from the respective cylinder bores 1*b* toward the discharge chamber 18 during rotation thereof together with the drive shaft 6 in addition to the afore-mentioned suction control function.

Figure 18:
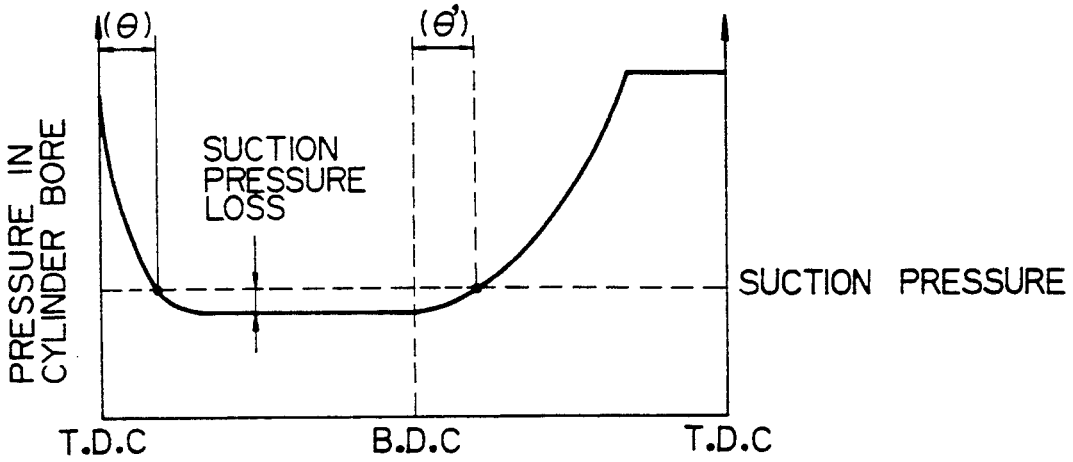
FIG. 18 is a graphical view, illustrating a relationship between a piston stroke and an pressure in a cylinder bore of the compressor of FIG. 12.

When the rotary valve element 22 is provided with both the fluid passageway 25 and the axial passageway 27, a predetermined spatial relationship between these two fluid passageways is established to obtain appropriate control of both suction and discharge of the refrigerant with respect to respective cylinder bores 1*b*. Namely, as best shown in FIGS. 17 and 18, the circumferential groove 25*b* of the fluid passageway 25 is formed in the outer circumference of the rotary valve element 22 in such a manner that in response to the rotation of the element 22 together with the drive shaft 6 in the direction shown by an arrow "A", the leading end of the circumferential groove 25*b* is brought into fluid communication with one of the cylinder bores 1*b* via the associated radial passageway 21 when the piston 15 in the cylinder bore 1*b* is moved away from the top dead center (T.D.C.) thereof by an angular amount "$\theta$" thereby causing a delay of a commencement of the suction stroke with respect to the cylinder bore 1*b*.

At this stage, since the axial passageway 27 of the rotary valve element 22 is arranged to be circumferentially spaced from the leading end of the circumferential passageway 25*b*, re-expansion of the compressed refrigerant remaining in the cylinder bore 1*b* occurs during the time period corresponding to the above-mentioned angular amount "$\theta$" of the rotation of the rotary valve element 22.

On the other hand, the circumferential passageway 25*b* of the rotary valve element 22 is extended so that the tail end thereof passes another cylinder bore 1*b* wherein the piston 15 reaches the bottom dead center (B.D.C.) thereof when the piston 15 is moved away from the B.D.C by a predetermined amount corresponding to an angular amount "$\theta'$" of the rotation of the rotary valve element 22. Namely, commencement of the compression stroke within the cylinder bore 1*b* is delayed as clearly shown in FIG. 18. FIG. 18 illustrates that the delay of the commencement of the compression stroke with respect to the cylinder bore 1*b* can compensate for pressure loss in the suction of the refrigerant caused by the above-mentioned delay in the commencement of the suction stroke with respect to the cylinder bore 1*b*.

In accordance with the above-mentioned arrangement of the flui passageway 25 and the circumferential passageway 27 of the rotary valve element 22, it is ensured that the circumferential outer surface of the rotary valve element 22 is provided with a predetermined length of land portion between the axial passageway 27 and the leading end of the circumferential passageway 25*b* as clearly shown in FIG. 17. Thus, each of the cylinder bores 1*b* does not simultaneously communicate with both suction and discharge chambers 17 and 18 of the rear housing 4 via the rotary valve element 22, and accordingly, the compressed refrigerant does not directly leak from the cylinder bore 1*b* toward the suction chamber 17.

When the rotary valve element 22 is provided with both suction and discharge control functions, pressure loss of the refrigerant gas during the operation of the reciprocatory piston type compressor can be significantly lowered compared with the compressor provided with the conventional flapper-form suction and discharge valves, and accordingly, the volumetric efficiency of the compressor can be considerably enhanced. Further, an elimination of the flapper-form valves from the compressor can significantly contribute to a reduction of noise during the operation of the compressor and to a reduction in valve damage or breakage during the operation life of the compressor.

Further, since the single rotary valve element 22 controls the suction and discharge of the refrigerant with respect to the plurality of cylinder bores 1*b*, it is possible to reduce the number of elements for constructing one reciprocatory piston type compressor while simplifying the construction of the compressor. Thus, the manufacturing cost of the reciprocatory piston type compressor can be lowered.

In the described embodiments, the reciprocatory piston type compressor is provided with a plurality of cylinder bores in which a plurality of single-headed pistons are reciprocated to conduct the suction, compression, and discharge operation under the control of the rotary valve element. Nevertheless, it should be understood that the rotary valve element formed as a rotary suction control valve or a rotary suction and discharge control valve can equally be applicable to the other reciprocatory piston type compressor provided with a plurality of double-headed reciprocatory pistons reciprocated by a swash plate mechanism having a fixed inclination angle. Namely, in the case of the double headed piston type compressor, two rotary valve elements are attached to opposite ends of a drive shaft that is rotated to thereby causing rotating and wobbling motions of the swash plate in the swash plate chamber provided in the center of the cylinder block.

From the foregoing description, it will be understood that according to the present invention, a reciprocatory piston type refrigerant compressor having high volumetric efficiency and capable of exhibiting a noise free and a damage free operation with a long operation life can be realized.

It should, however, be noted that many variations and modifications will occur to persons skilled in the art without departing from the spirit and scope of the present invention as claimed in the appended claims.

We claim:

1. A reciprocatory piston type refrigerant compressor for compressing a refrigerant of a refrigeration system comprising:

a cylinder block having a central axis thereof, a cylindrical central bore formed to be coaxial with the central axis, and a plurality of axial cylinder bores arranged around and parallel with the central axis, each axial cylinder bore having at least one bore end through which the refrigerant enters therein, and is discharged therefrom;

housing means air-tightly connected, via a partition wall plate means, to opposite axial ends of said cylinder block for defining therein a suction chamber for the refrigerant, before compression, fluidly communicating with said cylindrical central bore of said cylinder block, and a discharge chamber for the refrigerant, after compression, located around and isolated from said suction chamber;

a rotatable drive shaft having axial ends thereof rotatably supported by bearings seated in said housing means and said cylinder block;

a plurality of reciprocatory pistons fitted in said plurality of axial cylinder bores of said cylinder block; each piston being reciprocated in one of said plurality of cylinder bores for suction, compression, and discharge of the refrigerant;

a swash plate-operated piston drive mechanism arranged around said rotatable drive shaft for driving reciprocation of said plurality of reciprocatory pistons in said plurality of cylinder bores in cooperation with said drive shaft;

means for forming a constant fluid communication between each of said plurality of cylinder bores and said central bore of said cylinder block; and a rotary valve means arranged in said central bore of said cylinder block and attached to said drive shaft so as to be rotated together with said drive shaft; said rotary valve means being provided with a fluid passageway formed therein for controlling a supply of the refrigerant before compression from said suction chamber of said housing means to at least one of said plurality of cylinder bores via said means for forming a constant fluid communication while said at least one cylinder bore is in the suction phase to draw therein the refrigerant before compression in cooperation with said reciprocatory pistons, in response to the rotation of said drive shaft and said rotary valve means.

2. A reciprocatory piston type refrigerant compressor according to claim 1, wherein said means for forming a constant fluid communication between each of said plurality of cylinder bores and said central bore of said cylinder block comprises a plurality of radial passageways formed in said partition wall plate means; each of said radial passageways having radially opposite first and second ends; said first end constantly communicating with said central bore of said cylinder block, and said second end constantly communicating with said bore end of one of said plurality of cylinder bores.

3. A reciprocatory piston type refrigerant compressor according to claim 1, wherein said means for forming a constant fluid communication between each of said plurality of cylinder bores and said central bore of said cylinder block comprises a plurality of radial bores formed in said cylinder block; each of said radial bores having radially opposite first and second ends; said first end constantly communicating with said central bore of said cylinder block, and said second end constantly communicating with said bore end of one of said plurality of cylinder bores.

4. A reciprocatory piston type refrigerant compressor according to claim 1, wherein said rotary valve means comprises a cylindrical element keyed to one of said axial ends of said drive shaft, and having a cylindrical outer surface thereof slidably fitted in said cylindrical central bore of said cylinder block, and wherein said fluid passageway of said rotary valve means comprises an axial blind bore centrally formed in said cylindrical element and communicating with said suction chamber of said housing means; a circumferential groove formed in said cylindrical outer surface of said cylindrical element capable of communicating with said plurality of cylinder bores via said means for forming a constant fluid communication between each of said plurality of cylinder bores and said central bore of said cylinder block and having a predetermined circumferential length thereof, and a radial bore formed therein to fluidly connect said axial blind bore to said circumferential groove.

5. A reciprocatory piston type refrigerant compressor according to claim 4, wherein said cylindrical element of said rotary valve means is axially supported by a thrust bearing held in a bearing seat formed in said suction chamber of said housing means.

6. A reciprocatory piston type refrigerant compressor according to claim 5, wherein said cylindrical element of said rotary valve means is constantly axially urged toward said thrust bearing means by an elastic means, so that any axial play of said cylindrical element is prevented during rotation thereof together with said drive shaft.

7. A reciprocatory piston type refrigerant compressor according to claim 4, wherein said predetermined circumferential length of said circumferential groove of said rotary valve means is determined so that said each cylinder bore of said cylinder block is brought into communication with said suction chamber after a selected short time period during which the refrigerant gas after compression remaining in said bore end of said cylinder bore is permitted to expand.

8. A reciprocatory piston type refrigerant compressor according to claim 7, wherein said predetermined circumferential length of said circumferential groove of said rotary valve means is further determined so that each cylinder bore of said cylinder block is disconnected from said suction chamber after another selected short time period during which the refrigerant before compression supplied into said cylinder bore begins to be compressed.

9. A reciprocatory piston type refrigerant compressor according to claim 1, wherein said rotary valve means comprises:

a cylindrical element keyed to one of said axial ends of said drive shaft, and having a cylindrical outer surface thereof; and a cylindrical hollow sleeve element fixedly fitted in said cylindrical central bore of said cylinder block; said cylindrical hollow sleeve element being provided with a cylindrical wall defining an axial bore therein rotatably receiving said cylindrical element, and a plurality of windows formed in said cylindrical wall to constantly communicate with said means for forming a constant fluid communication between each of said plurality of cylinder bores and said central bore of said cylinder block, and wherein said fluid passageway of said rotary valve means comprises:

an axial blind bore centrally formed in said cylindrical element and communicated with said suction chamber of said housing menas, a circumferential groove formed in said cylindrical outer surface of said cylindrical element to be communicable with said plurality of cylinder bores via said plurality of windows of said cylindrical hollow sleeve element and said means for forming a constant fluid communication between each of said plurality of cylinder bores and said central bore of said cylinder block; said circumferential groove having a predetermined circumferential length thereof; and a radial bore formed therein to fluidly connect said axial blind bore to said circumferential groove.

10. A reciprocatory piston type refrigerant compressor according to claim 9, wherein said cylindrical hollow sleeve element is seated against an annular step formed in said housing means so as to surround said suction chamber whereby said axial bore of said cylindrical hollow sleeve element is constantly communicating with said suction chamber.

11. A reciprocatory piston type refrigerant compressor according to claim 1, wherein said housing means is provided with a cylindrical partition wall formed therein to have a cylindrical wall surface enclosing said suction chamber to thereby separate said suction chamber from said discharge chamber, and wherein said rotary valve means is further provided with a portion thereof rotatably engaged in said cylindrical wall surface of said cylindrical partition wall of said housing means, and an additional fluid passageway formed therein for controlling a discharge of the refrigerant after compression from at least one of said plurality of cylinder bores to said discharge chamber of said housing means via said means for forming a constant fluid communication between each of said plurality of cylinder bores and said central bore of said cylinder block and a plurality of discharge bores formed in said cylindrical partition wall of said housing means to open said discharge chamber while at least one cylinder bore is carrying out a discharge stroke discharging therefrom the refrigerant after compression in cooperation with said reciprocatory pistons, in response to the rotation of said drive shaft and said rotary valve means.

12. A reciprocatory piston type refrigerant compressor according to claim 11, wherein said additional fluid passageway of said rotary valve means comprises an axial groove formed therein so as to be capable of communicating said means for forming a constant fluid communication between each of said plurality of cylinder bores and said central bore of said cylinder block with one of said plurality of discharge bores of said housing means in sequence in response to the rotation of said rotary valve means.

13. A reciprocatory piston type refrigerant compressor according to claim 11, wherein said means for forming a constant fluid communication between each of said plurality of cylinder bores and said central bore of said cylinder block comprises a plurality of radial passageways formed in said partition wall plate means, and wherein said additional fluid passageway of said rotary valve means comprises an axial groove formed therein so as to be capable of communicating each of said plurality of radial passageways of said partition wall plate means with one of said plurality of discharge bores of said housing means in sequence in response to the rotation of said rotary valve means.

14. A reciprocatory piston type refrigerant compressor for compressing a refrigerant of a refrigeration system comprising:

a cylinder block having a central axis thereof, a first cylindrical valve chamber bored coaxially with the central axis, and a plurality of axial cylinder bores arranged around and in parallel with the central axis, each axial cylinder bore having at least one bore end through which the refrigerant enters therein, and is discharged therefrom;

housing means air-tightly connected, via a partition wall plate means, to opposite axial ends of said cylinder block for defining therein a suction chamber for the refrigerant before compression fluidly communicating with said first cylindrical valve chamber of said cylinder block, and a discharge chamber for the refrigerant after compression located around and isolated from said suction chamber; said housing means further defining a second cylindrical valve chamber coaxial with said first cylindrical valve chamber;

a rotatable drive shaft having axial ends thereof rotatably supported by bearings seated in said housing means and said cylinder block;

a plurality of reciprocatory pistons fitted in said plurality of axial cylinder bores of said cylinder block; each piston being reciprocated in one of said plurality of cylinder bores for suction, compression, and discharge of the refrigerant;

a swash plate-operated piston drive mechanism arranged around said rotatable drive shaft for driving reciprocation of said plurality of reciprocatory pistons in said plurality of cylinder bores in cooperation with said drive shaft;

first means for forming a constant fluid communication between each of said plurality of cylinder bores and said first cylindrical valve chamber of said cylinder block;

second means for forming constant fluid communication between said discharge chamber and said second cylindrical valve chamber of said housing means; and a rotary valve means arranged in said first and second valve chambers of said cylinder block and said housing means, and attached to said drive shaft so as to be rotated together with said drive shaft;

said rotary valve means being provided with a first fluid passageway formed therein for controlling a supply of the refrigerant before compression from said suction chamber of said housing means to at least one of said plurality of cylinder bores via said first means for forming constant fluid communication while at least one cylinder bore is in the suction phase drawing therein the refrigerant before compression in cooperation with said reciprocatory pistons, in response to the rotation of said drive shaft, and a second fluid passageway formed therein for controlling a discharge of the refrigerant after compression from at least one of said plurality of cylinder bores to said discharge chamber via said first and second means for forming constant fluid communication while at least one cylinder bore is in the discharge phase so as to discharge the refrigerant after compression in cooperation with said reciprocatory pistons, in response to the rotation of said drive shaft.

15. A reciprocatory piston type refrigerant compressor according to claim 14, wherein said second fluid passageway of said rotary valve means comprises an axial groove formed in said cylindrical outer surface of said cylindrical element.

16. A reciprocatory piston type refrigerant compressor according to claim 14, wherein said rotary valve means comprises a cylindrical element keyed to one of said axial ends of said drive shaft, and having a cylindrical outer surface thereof to be slidably fitted in said first and second valve chambers, and wherein said first fluid passageway of said rotary valve means comprises an axial blind bore centrally formed in said cylindrical element and communicating with said suction chamber of said housing means; a circumferential groove formed in said cylindrical outer surface of said cylindrical element so as to be capable of communicating with said plurality of cylinder bores via said first means for forming a constant fluid communication between each of said plurality of cylinder bores and said first cylindrical valve chamber of said cylinder block and having a predetermined circumferential length thereof, and a radial bore formed therein to fluidly connect said axial blind bore to said circumferential groove.

17. A reciprocatory piston type refrigerant compressor according to claim 16, wherein said predetermined circumferential length of said circumferential groove of said rotary valve means is determined so that said each cylinder bore of said cylinder block is brought into communication with said suction chamber after a selected short time period during which the refrigerant gas after compression remaining in said bore end of said cylinder bore is permitted to expand.

18. A reciprocatory piston type refrigerant compressor according to claim 17, wherein said predetermined circumferential length of said circumferential groove of said rotary valve means is further determined so that each cylinder bore of said cylinder block is disconnected from said suction chamber after another selected short time period during which the refrigerant before compression supplied into said cylinder bore begins to be compressed.

19. A reciprocatory piston type refrigerant compressor according to claim 14, wherein said housing means is provided with a cylindrical partition wall formed therein enclosing said suction and second valve chambers to thereby isolate said suction chamber from said discharge chamber, and wherein said second means for forming constant fluid communication between said discharge chamber and said second cylindrical valve chamber of said housing means comprises a plurality of radial bores formed in said cylindrical partition wall to provide fluid communication between said discharge chamber and said second valve chamber.

* * * * *